US006017666A

United States Patent [19]

Nealey et al.

[11] Patent Number: 6,017,666

[45] Date of Patent: Jan. 25, 2000

[54] CHARGE GENERATING COMPOSITION

[75] Inventors: Richard H. Nealey, Penfield; Kenny T. T. Dinh, Webster; John G. Matta, E. Rochester, all of N.Y.

[73] Assignee: Xerox Corporation, Stamford, Conn.

[21] Appl. No.: 09/172,702

[22] Filed: Oct. 14, 1998

[51] Int. Cl.[7] ..... G03G 15/02

[52] U.S. Cl. ..... 430/59.4; 430/59.6

[58] Field of Search ..... 430/59.4, 59.6

[56] References Cited

U.S. PATENT DOCUMENTS 5,418,107 5/1995 Nealey et al. ..... 430/132

5,456,998 10/1995 Burt et al. ..... 430/58

5,681,678 10/1997 Nealey et al. ..... 430/58

5,725,985 3/1998 Nealey et al. ..... 430/59

5,759,726 6/1998 Tambo et al. ..... 430/59.4

*Primary Examiner*—John L Goodrow

*Attorney, Agent, or Firm*—Zosan S. Soong

[57] ABSTRACT

A charge generating composition comprising: a hydroxygallium phthalocyanine an alkoxy-bridged metallophthalocyanine dimer, and a polymer matrix comprised of a reaction product copolymerized from reactants including a vinyl chloride monomer, a vinyl acetate monomer, and a hydroxyalkyl acrylate monomer.

15 Claims, 1 Drawing Sheet

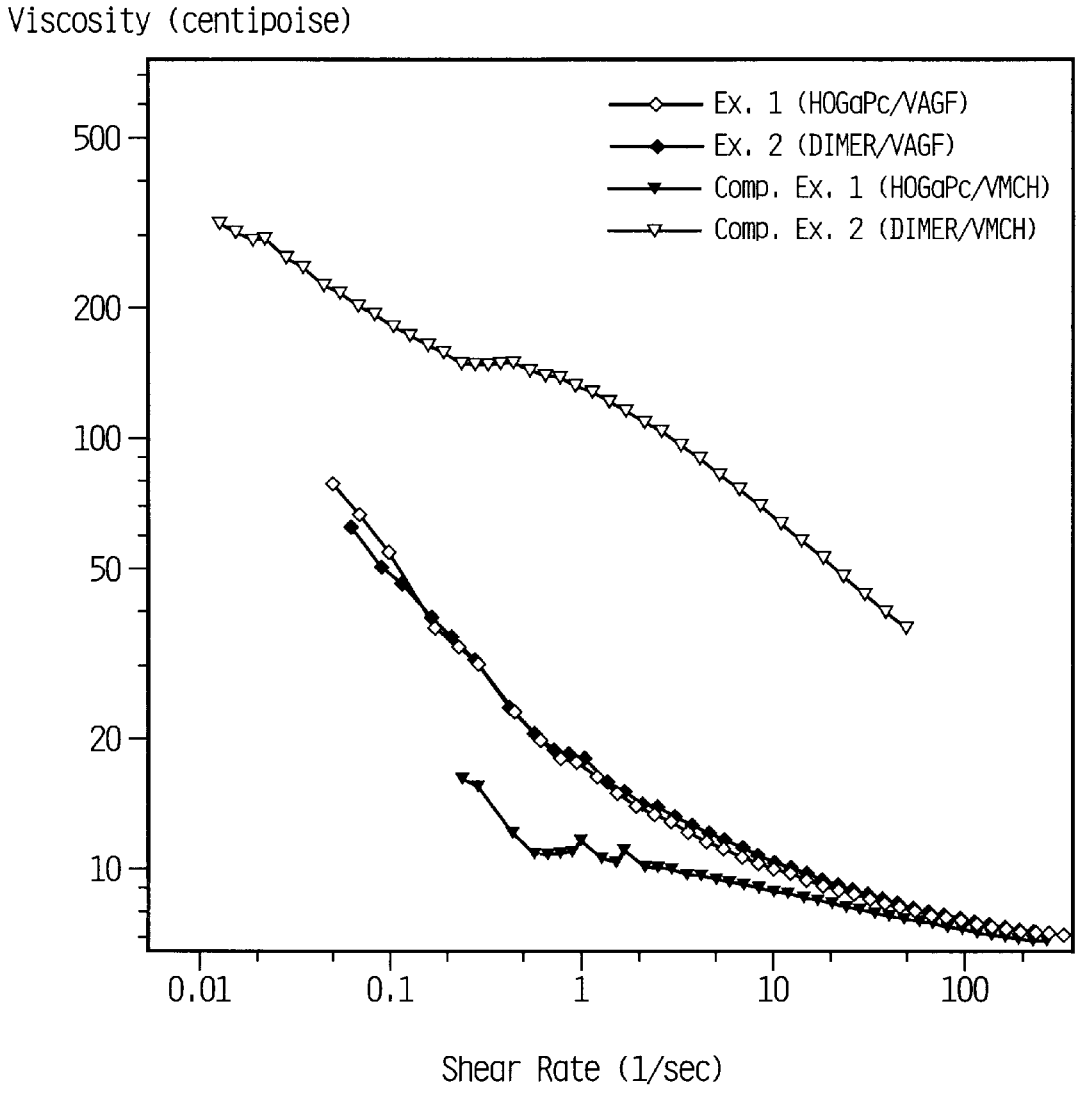
Viscosity (centipoise)
500
200
100
50
20
10
Ex. 1 (HOGaPc/VAGF)
Ex. 2 (DIMER/VAGF)
Comp. Ex. 1 (HOGaPc/VMCH)
Comp. Ex. 2 (DIMER/VMCH)
0.01
0.1
1
10
100
Shear Rate (1/sec)

CHARGE GENERATING COMPOSITION

FIELD OF THE INVENTION

This invention relates to a charge generating composition that can be employed as a charge generating layer of an imaging member.

BACKGROUND OF THE INVENTION

A conventional technique for coating cylindrical or drum shaped photoreceptor substrates involves dipping the substrates in coating baths. The bath used for preparing photoconducting layers is prepared by dispersing photoconductive pigment particles in a solvent solution of a film forming binder. Unfortunately, some organic photoconductive pigment particles cannot be applied by dip coating to form high quality photoconductive coatings. For example, organic photoconductive pigment particles such as hydroxygallium phthalocyanine pigment particles tend to settle when attempts are made to disperse the pigments in a solvent solution of a film forming binder. The tendency of the particles to settle requires constant stirring which can lead to entrapment of air bubbles that are carried over into the final photoconductive coating deposited on a photoreceptor substrate. These bubbles cause defects in final prints xerographically formed with the photoreceptor. The defects are caused by differences in discharge of the electrically charged photoreceptor between the region where the bubbles are present and where the bubbles are not present. Thus, for example, the final print will show dark areas over the bubbles during discharged area development or white spots when utilizing charged area development. Moreover, many pigment particles tend to agglomerate when attempts are made to disperse the pigments in solvent solutions of film forming binders. The pigment agglomerates lead to nouniform photoconductive coatings which in turn lead to other print defects in the final xerographic prints due to nonuniform discharge. The film forming binder selected for photoconductive pigment particles in a charge generating layer can adversely affect the particle dispersion uniformity, coating composition rheology, residual voltage after erase and electrophotographic sensitivity. Some binders can lead to unstable pigment particle dispersions which are unsuitable for coating photoreceptors. Thus, for example, when a copolymer reaction product of 86 weight percent vinyl chloride and 14 weight percent vinyl acetate such as VYHH terpolymer from Union Carbide is utilized to disperse hydroxygallium phthalocyanine photoconductive particles, an unstable dispersion is obtained. Moreover, a charge generating layer containing this copolymer has poor light sensitivity and gives high residual voltage after erase. Combinations of some polymers can result in unacceptable coating or electrical properties. For example, some polymers are incompatible with each other and cannot form coatings in which the polymers or particles are distributed uniformly throughout the final coating.

Photoconductive compositions are also difficult to modify for electrophotographic copiers, duplicators and printers characterized by different sensitivity requirements. Thus, custom photogenerating layer compositions must be prepared for each type of machine having its own different specific sensitivity requirement. The addition of a relatively insensitive pigment to a highly sensitive photoconductive pigment can alter the overall sensitivity of a photoreceptor. However, uniform electrical characteristics from one batch to the next batch is difficult to achieve because of uneven pigment distribution of the two different pigment particles in the final dried charge generation layer. Variations in distribution might be due to property differences of the different pigment materials employed such as size, shape, wetting characteristics, density, triboelectric charge, and the like. For example, some dispersions behave in a non-uniform manner when deposited as a coating on a photoreceptor substrate to form discontinuous coatings during dip coating or roll coating operations. It is believed that these discontinuous coatings are caused by the coating material flowing in some regions of the areas being coated and not in other regions. Thus, there is a need which the present invention addresses for new charge generating compositions containing two types of pigments that exhibit good dispersion and coating qualities.

Conventional charge generating compositions are disclosed in Nealey et al., U.S. Pat. No. 5,681,678; Nealey et al., U.S. Pat. No. 5,725,985; Burt et al., U.S. Pat. No. 5,456,998; and Nealey et al., U.S. Pat. No. 5,418,107.

Photoreceptors have been commercially available from Xerox Corp. for over a year that contain a layer of a charge generating composition composed of a hydroxygallium phthalocyanine, an alkoxy-bridged metallophthalocyanine dimer, and a polymer matrix ("VMCH") of 86% by weight vinyl chloride, 13% by weight vinyl acetate, and 1% by weight maleic acid where the VMCH has a molecular weight of about 27,000.

SUMMARY OF THE INVENTION

The present invention is accomplished in embodiments by providing a charge generating composition comprising: a hydroxygallium phthalocyanine, an alkoxy-bridged metallophthalocyanine dimer, and a polymer matrix comprised of a reaction product copolymerized from reactants including a vinyl chloride monomer, a vinyl acetate monomer, and a hydroxyalkyl acrylate monomer.

In embodiments, there is provided an imaging member comprising:

(a) a substrate;

(b) a charge generating layer including the present charge generating composition; and (c) a charge transport layer, wherein the generating layer and the transport layer are in any sequence after the substrate.

BRIEF DESCRIPTION OF THE DRAWINGS

The Figure is a graph depicting viscosity versus shear rate for several charge generating compositions.

DETAILED DESCRIPTION

Electrophotographic imaging members, i.e., photoreceptors, are well known in the art. Typically, a substrate is provided having an electrically conductive surface. At least one photoconductive layer is then applied to the electrically conductive surface. A charge blocking layer may be applied to the electrically conductive surface prior to the application of the photoconductive layer. If desired, an adhesive layer may be utilized between the charge blocking layer and the photoconductive layer. For multilayered photoreceptors, a charge generation layer is usually applied onto the blocking layer and a charge transport layer is formed on the charge generation layer. However, if desired, the charge generation layer may be applied to the charge transport layer.

The substrate may be opaque or substantially transparent and may comprise numerous suitable materials having the required mechanical properties. Accordingly, the substrate may comprise a layer of an electrically non-conductive or conductive material such as an inorganic or an organic composition.

The thickness of the substrate layer depends on numerous factors, including beam strength and economic considerations, and thus this layer for a flexible belt may be of substantial thickness, for example, about 125 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers. Substrates in the shape of a drum or cylinder may comprise a metal, plastic or combinations of metal and plastic of any suitable thickness depending upon the degree of rigidity desired.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Where the substrate is metallic, such as a metal drum, the outer surface thereof is normally inherently electrically conductive and a separate electrically conductive layer need not be applied.

After formation of an electrically conductive surface, a hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. Blocking layers are well known. The blocking layer may comprise an oxidized surface which inherently forms on the outer surface of most metal ground plane surfaces when exposed to air. The blocking layer may be applied as a coating by any suitable conventional technique. The blocking layer should be continuous and have a thickness of less than about 2 micrometers, preferably about 1 to about 2 micrometers, because greater thicknesses may lead to undesirably high residual voltage. The blocking layer is preferably composed of three components: zirconium tributoxides, gamma amino propyltriethoxy silane, and polyvinyl butyral (e.g., BM-S™ available from Sekisui Chemical Company). The proportions of these three components are as follows: 2 parts of the zirconium tributoxides to 1 part gamma amino propyltriethoxy silane by mole ratio; and 90 parts by weight of the above mixture of the zirconium tributoxides and gamma amino propyltriethoxy silane to 10 parts by weight of the polyvinyl butyral.

An optional adhesive layer may applied to the hole blocking layer. Any suitable adhesive layer well known in the art may be utilized. Satisfactory results may be achieved with adhesive layer thickness between about 0.05 micrometer.

In the photogenerating composition of this invention, particles of the photoconductive hydroxygallium phthalocyanine and the alkoxy-bridged metallophthalocyanine dimer are dispersed in a polymer matrix, the matrix comprising a polymeric film forming reaction product of at least vinyl chloride, vinyl acetate and hydroxyalkyl acrylate. Photoconductive hydroxygallium phthalocyanine particles are well known in the art. These particles are available in numerous polymorphic forms. Any suitable hydroxygaffium phthalocyanine polymorph may be used in the charge generating composition of this invention. Hydroxygallium phthalocyanine polymorphs are extensively described in the technical and patent literature. For example, hydroxygallium phthalocyanine Type V and other polymorphs are described in U.S. Pat. No. 5,521,306, the disclosure of which is totally incorporated herein by reference.

The alkoxy-bridged metallophthalocyanine dimer (herein referred to as "dimer") is described in U.S. Pat. No. 5,456,998, the disclosure of which is totally incorporated herein by reference, and has the general formula:

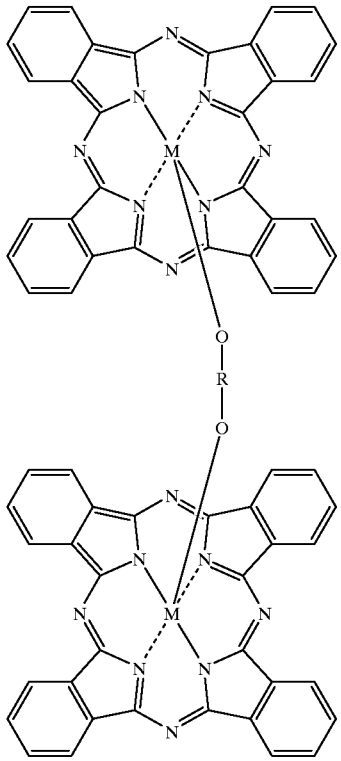

wherein the R substituent in in the alkoxy-bridge (i.e., —O—R—O) is an alkyl group or an alkyl ether group with R having for example from 2 to about 10 carbon atoms, preferably about 2 to 6 carbon atoms; M is a metal such as aluminum, gallium, indium, or a trivalent metal of Mn(III), Fe(III), Co(III), Ni(III), Cr(III), or V(III). Examples of specific dimers include 1,2-di(oxoaluminum phthalocyaninyl) ethane, 1,2-di(oxogallium phthalocyaninyl) ethane, 1,2-di(oxoindium phthalocyaninyl) ethane, 1,3-di(oxoaluminum phthalocyaninyl) propane, 1,3-di(oxogallium phthalocyaninyl) propane, 1,3-di(oxoindium phthalocyaninyl) propane, 1,2-di(oxoaluminum phthalocyaninyl) propane, 1,2-di(oxogallium phthalocyaninyl) propane, and 1,2-di(oxoindium phthalocyaninyl) propane. In embodiments, the ratio of the hydroxygalfium phthalocyanine and the dimer ranges from about 90 (hydroxygallium phthalocyanine):10 (dimer) by weight to about 10 (hydroxygallium phthalocyanine):90 (dimer) by weight, based on the weight of the hydroxygallium phthalocyanine and the dimer. Generally, the photoconductive pigment particle size utilized is less than the thickness of the dried charge generating layer and the average particle size is less than about 1 micrometer. Satisfactory results are achieved with an average photoconductive particle size of less than about 0.6 micrometer when the photoconductive coating is applied by dip coating. Preferably, the average photoconductive particle size is less than about 0.4 micrometer. Optimum results are achieved with an average particles size of less than about 0.1 micrometer.

The polymer matrix in the charge generating composition of this invention comprises a polymeric film forming reaction product of at least vinyl chloride, vinyl acetate and hydroxyalkyl acrylate. The film forming polymer is the reaction product of at least vinyl chloride, vinyl acetate and a hydroxyalkyl acrylate prepared using conventional emulsion or suspension polymerization techniques. The chain length can be controlled by varying the reaction temperature and time. For utilization in the photoconductive layer of this invention, one embodiment of the polymer may be formed from a reaction mixture comprising between about 80 percent and about 90 percent by weight vinyl chloride, between about 3 percent and about 15 percent by weight vinyl acetate and between about 6 percent and about 20 percent by hydroxyalkyl acrylate, based on the total weight of the reactants for the terpolymer.

This terpolymer may be represented by the following formula:

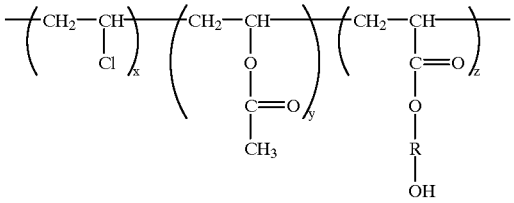

wherein

R is an alkyl group containing 2 to 3 carbon atoms;

x is the proportion of the polymer derived from a reaction mixture comprising between about 80 percent and about 90 percent by weight vinyl chloride;

y is the proportion of the polymer derived from a reaction mixture comprising between about 3 percent and about 15 percent by weight vinyl acetate; and z is the proportion of the polymer derived from a reaction mixture comprising between about 6 percent and about 20 percent by weight hydroxyalkyl acrylate, based on the total weight of the reactants for the terpolymer.

These film forming terpolymers are commercially available and include, for example, VAGF resin—a polymeric reaction product of 81 weight percent vinyl chloride, 4 weight percent vinyl acetate and 15 weight percent hydroxyethyl acrylate having a weight average molecular weight of about 33,000 (available from Union Carbide Co.), and the like. Satisfactory results may be achieved when the matrix terpolymer is a solvent soluble terpolymer having a weight average molecular weight of at least about 15,000. Preferably, these terpolymers have a weight average molecular weight of between about 15,000 and about 45,000. When the molecular weight is below about 35,000, poor film forming properties and undesirable dispersion characteristics can be encountered.

Instead of the terpolymer described above, the charge generating composition of this invention may comprise a polymeric film forming reaction product of vinyl chloride, vinyl acetate, hydroxyalkyl acrylate and maleic acid. These reactants may form the tetrapolymer with the final tetrapolymer containing a spine of carbon atoms. The tetrapolymer chain length can be controlled by varying the reaction temperature and time. For utilization in the photoconductive composition of this invention, this embodiment of the polymer may be formed from a reaction mixture comprising between about 80 percent and about 90 percent by weight vinyl chloride, between about 3 percent and about 15 percent by weight vinyl acetate, between about 6 percent and about 20 percent by weight hydroxyalkyl acrylate and between about 0.25 percent and about 0.38 percent by weight of maleic acid based on the total weight of the reactants for the tetrapolymer. In embodiments, there may be less than about 1 percent by weight of the maleic acid monomer, based on the weight of the reactants.

The proportion of maleic acid present in the final polymer can vary from 0 weight percent to 0.38 weight percent without adversely affecting the quality of the dispersion or the coating quality.

The tetrapolymer may be represented by the following formula:

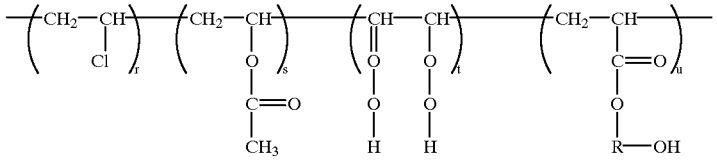

wherein

R is an alkyl group containing 2 to 3 carbon atoms;

r is the proportion of the tetrapolymer derived from a reaction mixture comprising between about 80 percent and about 90 percent by weight vinyl chloride;

s is the proportion of the tetrapolymer derived from a reaction mixture comprising between about 3 percent and about 15 percent by weight vinyl acetate;

t is the proportion of the tetrapolymer derived from a reaction mixture comprising up to 0.4 percent by weight maleic acid; and u is the proportion of the tetrapolymer derived from a reaction mixture comprising between about 6 percent and about 20 percent by weight hydroxyalkyl acrylate based on the total weight of the reactants for the tetrapolymer.

The film forming tetrapolymers of this embodiment are commercially available and include, for example, UCAR-Mag 527 resin—a polymeric reaction product of 81 weight percent vinyl chloride, 4 weight percent vinyl acetate, 15 weight percent hydroxyethyl acrylate, and 0.28 weight percent maleic acid having a weight average molecular weight of about 35,000 (available from Union Carbide Co.). Satisfactory results may be achieved when the tetrapolymer is a solvent soluble polymer having a weight average molecular weight of about 35,000. Preferably, these tetrapolymers have a weight average molecular weight of between about 20,000 and about 50,000. When the molecular weight is below about 20,000, poor film forming properties and undesirable dispersion characteristics can be encountered.

The alkyl component of the hydroxyalkyl acrylate reactant for the terpolymer or tetrapolymer described above contains from 2 to 3 carbon atoms and includes, for example, ethyl, propyl, and the like. A proportion of hydroxyalkyl acrylate reactant of less than about 6 percent may adversely affects the quality of the dispersion. After the film forming matrix polymer is formed, the polymer preferably comprises a carbonyl hydroxyl copolymer having a hydroxyl content of between about 1 weight percent and about 5 weight percent, based on the total weight of the terpolymer or tetrapolymer. Mixtures of the above polymers can also be used in any combination.

Any suitable solvent may be employed to dissolve the film forming polymer or polymers utilized in the charge generating composition of this invention. Typical solvents include, for example, esters, ethers, ketones, mixtures thereof, and the like. Specific solvents include, for example, n-butyl acetate, cyclohexanone, tetrahydrofuran, methyl ethyl ketone, toluene, mixtures of methyl ethyl ketone and toluene, mixtures of tetrahydrofuran and toluene and the like.

Any suitable technique may be utilized to disperse the pigment particles in the solution of the film forming polymer or polymers dissolved in a suitable solvent. Typical dispersion techniques include, for example, ball milling, roll milling, mlling in vertical or horizontal attritors, sand milling, and the like which utilize milling media. The solids content of the mixture being milled does not appear critical and can be selected from a wide range of concentrations. Typical milling times using a ball roll mill is between about 4 and about 6 days. If desired, the photoconductive particles with or without film forming binder may be milled in the absence of a solvent prior to forming the final coating dispersion. Also, a concentrated mixture of photoconductive particles and binder solution may be initially milled and thereafter diluted with additional binder solution for coating mixture preparation purposes. The resulting dispersion may be applied to the adhesive blocking layer, a suitable electrically conductive layer or to a charge transport layer. When used in combination with a charge transport layer, the photoconductive layer may be between the charge transport layer and the substrate or the charge transport layer can be between the photoconductive layer and the substrate.

Any suitable technique may be utilized to apply the coating to the substrate to be coated. Typical coating techniques include dip coating, roll coating, spray coating, rotary atomizers, and the like. The coating techniques may use a wide concentration of solids. Preferably, the solids content is between about 2 percent by weight and 8 percent by weight based on the total weight of the dispersion. The expression "solids" refers to the pigment particle and binder components of the coating dispersion. These solids concentrations are useful in dip coating, roll coating, spray coating, and the like. Generally, a more concentrated coating dispersion is preferred for roll coating. Drying of the deposited coating may be effected by any suitable conventional technique such as oven drying, infra-red radiation drying, air drying and the like.

Satisfactory results are achieved when the dried photoconductive coating comprises between about 40 percent and about 80 percent by weight, preferably from about 50 percent to about 65 percent by weight, of the hydroxygallium phthalocyanine and the dimer particles based on the total weight of the dried charge generating layer. When the pigment concentration is less than about 40 percent by weight, particle to the particle contact is lost resulting in deterioration. Optimum imaging performance is achieved when the charge generating layer comprises about 60 percent by weight of the photoconductive particles based on the total weight of the dried charge generating layer. Since the photoconductor characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

For multilayered photoreceptors comprising a charge generating layer and a charge transport layer, satisfactory results may be achieved with a dried photoconductive layer coating thickness of between about 0.1 micrometer and about 10 micrometers. Preferably, the photoconductive layer thickness is between about 0.2 micrometer and about 1 micrometer. Optimum results are achieved with a generating layer having a thickness of between about 0.3 micrometer and about 0.7 micrometer. However, these thicknesses also depend upon the pigment loading. Thus, higher pigment loadings permit the use of thinner photoconductive coatings. Thicknesses outside these ranges can be selected providing the objectives of the present invention are achieved.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula: $(R_1)R_2NR_3$ wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free from electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; dimethyltriphenylmethane, N,N'-bis(alkylphenyl)-(1,1'-biphenyl)-4,4'-diamine wherein the alkyl is, for example, methyl, ethyl, propyl, n-butyl, etc., N,N'-diphenyl-N,N'-bis(chlorophenyl)-1,1'-bipheny)-4,4'-diamine, N,N'-diphenyl-N,N'-bis(3-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 150,000.

Any suitable and conventional technique may be utilized to mix and thereafter apply the charge transport layer coating mixture to the coated or uncoated substrate. Typical application techniques include spraying, dip coating, roll coating, wire wound rod coating, and the like. Drying of the deposited coating may be effected by any suitable conventional technique such as oven drying, infra-red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as LEXAN™ 145 from General Electric Company; poly(4,4'-isopropylidene-diphenylene carbonate) with a molecular weight of from about 40,000 to about 45,000, available as LEXAN™ 141 from the General Electric Company; a polycarbonate resin having a molecular weight of from about 50,000 to about 120,000, available as MAKROLON™ from Farbenfabricken Bayer A. G. and a polycarbonate resin having a molecular weight of from about 20,000 to about 50,000 available as MERLON™ from Mobay Chemical Company. Methylene chloride solvent is a desirable component of the charge transport layer coating mixture for adequate dissolving of all the components and for its low boiling point.

The photoreceptors may comprise, for example, a charge generator layer sandwiched between a conductive surface and a charge transport layer as described above or a charge transport layer sandwiched between a conductive surface and a charge generator layer.

Optionally, an overcoat layer may also be utilized to improve resistance to abrasion. In some cases an anti-curl back coating may be applied to the side opposite the photoreceptor to provide flatness and/or abrasion resistance where a web configuration photoreceptor is fabricated. These overcoating and anti-curl back coating layers are well known in the art. Overcoatings are continuous and generally have a thickness of less than about 10 micrometers. The thickness of anti-curl backing layers should be sufficient to substantially balance the total forces of the layer or layers on the opposite side of the supporting substrate layer. An example of an anti-curl backing layer is described in U.S. Pat. No. 4,654,284 the entire disclosure of this patent being incorporated herein by reference. A thickness between about 70 and about 160 micrometers is a satisfactory range for flexible photoreceptors.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE 1

A dispersion was prepared by dissolving a film forming binder composition in n-butyl acetate solvent and then adding hydroxygallium phthalocyanine ("HOGaPC") pigment. The binder concentration, based on the total weight of binder in the solution was 100 percent by weight of a terpolymer reaction product of 81 weight percent vinyl chloride, 4 weight percent vinyl acetate and 15 weight percent hydroxyethyl acrylate having a weight average molecular weight of about 33,000 (VAGF, available from Union Carbide Co.). The pigment concentration in the dispersion was 60 percent by weight based on the total solids weight (pigment and binder). The total weight of pigment and binder was 10% by weight of the total weight of the dispersion. The dispersion was milled in a ball mill with ⅛ inch (0.3 cm) diameter stainless steel shot for 6 days. The dispersion was filtered to remove the shot. This material was at 9.6 wt % solids and is referred to as the mill base. For dipcoating applications, solvent was added to adjust the solids coating to 4.8% by weight. The average particle size of the milled pigment was about 0.15 micrometer. Next, the charge generating layer coating by mixture was applied by a dip coating process in which a cylindrical 40 mm diameter and 310 mm long aluminum drum coated with a 0.1 micrometer thick zirconium silane coating was immersed into and withdrawn from the charge generating layer coating mixture in a vertical direction along a path parallel to the axis of the drum at a rate of 200 mm/mm. The applied charge generation coating was dried in an oven at 106° C. for 10 minutes to form a layer having a thickness of approximately 0.3 micrometer. This coated charge generator layer was then dip coated with a charge transport mixture containing 36 percent N,N'-diphenyl-N,N'-bis(3-methylphenyl)-(1,1'-biphenyl)-4,4' diamine and polycarbonate dissolved in monochlorobenzene solvent. The applied charge transport coating was dried in a forced air oven at 118° C. for 25 minutes to form a layer having a thickness of 20 micrometers. The electrophotographic imaging member prepared was tested by electrically charging it at a field of 800 volts and discharging it with light having a wavelength of 780 nm. The dispersion properties of the mill base used to prepare the coating dispersion are summarized in the following table:

| Mill Base Properties | | | | | |
|---|---|---|---|---|---|
| Pigment/Binder Ratio Wt. % | % Solids | Viscosity (cps) | Particle Size ($\mu$) | Power Law Fit | Yield Point |
| 60 | 9.6 | 7.9 | 0.15 | 0.85 | 0 |

All particle size determinations were accomplished on a Horiba model capa 700 particle size distribution analyzer in the solvents used for the pigment milling step. The expression "power law" is obtained by plotting the viscosity against the shear rate and measuring the slope of the resulting line. A value that approximates 1 is indicative of a newtonian fluid, i.e exhibits no change in viscosity with increasing shear. The viscosity values are in centipoise units and are reported for a shear value of 100 sec-i. The expression "yield point" is defmed as the resistance to flow until a certain shear value is applied. A value approximating 0 has no yield point and is desirable for dip coating purposes. This yield point value demonstrates that no yield point is observed in this dispersion. The rheology for the mill base is shown in the Figure.

EXAMPLE 2

The procedure described in Example 1 was repeated in the same manner except the dimer was substituted for the HOGaPC pigment. The dispersion quality was measured to give the following values:

| Mill Base Properties: | | | | | |
|---|---|---|---|---|---|
| Pigment/Binder Ratio Wt. % | % Solids | Viscosity (cps) | Particle Size ($\mu$) | Power Law Fit | Yield Point |
| 60 | 9.6 | 8.1 | 0.25 | 0.89 | 0 |

The complete Theological properties are shown in the Figure.

COMPARATIVE EXAMPLE 1

The procedure described in Example 1 was repeated in the same manner except the VAGF binder was substituted by VMCH binder which is composed of 86% by weight vinyl chloride, 13% by weight vinyl acetate, and 1% by weight maleic acid where the VMCH binder has a molecular weight of about 27,000.

The dispersion quality was measured to give the following values:

| Mill Base Properties: | | | | | |
|---|---|---|---|---|---|
| Pigment/Binder Ratio Wt. % | % Solids | Viscosity (cps) | Particle Size ($\mu$) | Power Law Fit | Yield Point |
| 60 | | 7.9 | 0.11 | 0.94 | 0 |

The Theological properties are shown graphically in the Figure.

COMPARATIVE EXAMPLE 2

The procedure described in Example 2 was repeated in the same manner except the VAGF binder was substituted by VMCH. The dispersion quality was measured to give the following values:

| Mill Base Properties: | | | | | |
|---|---|---|---|---|---|
| Pigment/Binder Ratio Wt. % | % Solids | Viscosity (cps) | Particle Size ($\mu$) | Power Law Fit | Yield Point |
| 60 | | 49 | 0.20 | 0.80 | 0 |

The Theological properties are graphically shown in the Figure.

As shown in the Figure, the dimer/VMCH mill base exhibits non-newtonian rheology with significant shear thinning flow properties and is quite different from the HOGaPc in VMCH dispersion. Such a difference can be expected to lead to problems in dip coating where flow characteristics should be as newtonian as possible. On the other hand, the dimer/VAGF and HOGaPc/VAGF dispersions appear Theologically identical and thus would be preferred over the whole range of mixtures as envisioned in this application. Further it has been shown that the photoelectric response of photoreceptors covering the range of mixtures show equivalent electrical properties for the VAGF formulations as compared to the VMCH formulations.

Other modifications of the present invention may occur to those skilled in the art based upon a reading of the present disclosure and these modifications are intended to be included within the scope of the present invention.

We claim:

1. A charge generating composition comprising: a hydroxygallium phthalocyanine, an alkoxy-bridged metallophthalocyanine dimer, and a polymer matrix comprised of a reaction product copolymerized from reactants including a vinyl chloride monomer, a vinyl acetate monomer, and a hydroxyalkyl acrylate monomer.

2. The generating composition of claim 1, wherein the alkoxy-bridged metallophthalocyanine dimer is an alkoxy-bridged gallium phthalocyanine dimer.

3. The generating composition of claim 1, wherein the alkoxy-bridged gallium phthalocyanine dimer has from 2 to about 10 carbon atoms in the alkoxy-bridge.

4. The generating composition of claim 1, wherein the reactants consist essentially of the vinyl chloride monomer, the vinyl acetate monomer, and the hydroxyalkyl acrylate monomer.

5. The generating composition of claim 1, wherein the reactants consist essentially of about 80 percent to about 90 percent by weight of the vinyl chloride monomer, about 3 percent to about 15 percent by weight of the vinyl acetate monomer, and about 6 percent to about 20 percent by weight of the hydroxyalkyl acrylate monomer, based on the weight of the reactants.

6. The generating composition of claim 1, wherein the reaction product has a weight average molecular weight of at least about 15,000.

7. The generating composition of claim 1, wherein the reaction product has a weight average molecular weight between about 15,000 and about 45,000.

8. The generating composition of claim 1, wherein the reactants further include less than about 1 percent by weight of a maleic acid monomer, based on the weight of the reactants.

9. The generating composition of claim 8, wherein the reactants consist essentially of about 80 percent to about 90 percent by weight of the vinyl chloride monomer, about 3 percent to about 15 percent by weight of the vinyl acetate monomer, about 6 percent to about 20 percent by weight of the hydroxyalkyl acrylate monomer, and about 0.25 percent to about 0.38 percent by weight of the maleic acid monomer, based on the weight of the reactants.

10. The generating composition of claim 1, wherein the total amount of the hydroxygallium phthalocyanine and the dimer in the composition ranges from about 50 percent to about 65 percent by weight based on the weight of the composition.

11. The generating composition of claim 1, wherein the total amount of the hydroxygallium phthalocyanine and the dimer in the composition is about 60 percent by weight based on the weight of the composition.

12. The generating composition of claim 1, wherein the ratio of the hydroxygallium phthalocyanine and the dimer ranges from about 90 (hydroxygallium phthalocyanine):10 (the dimer) by weight to about 10 (hydroxygallium phthalocyanine):90 (the dimer) by weight, based on the weight of the hydroxygallium phthalocyanine and the dimer.

13. An imaging member comprising:

(a) a substrate;

(b) a charge generating layer including a charge generating composition of claim 1; and (c) a charge transport layer, wherein the generating layer and the transport layer are in any sequence after the substrate.

14. The imaging member of claim 13, wherein the alkoxy-bridged metallophthalocyanine dimer is an alkoxy-bridged gallium phthalocyanine dimer.

15. The imaging member of claim 13, further comprising a blocking layer between the substrate and the charge generating layer.

* * * * *